United States Patent [19]

Giannini

[11] 4,019,672

[45] Apr. 26, 1977

[54] PACKING INSERT AND BLANK THEREFOR

[75] Inventor: Nunzio E. Giannini, Pompton Lakes, N.J.

[73] Assignee: Packaging Corporation of America, Evanston, Ill.

[22] Filed: Feb. 3, 1976

[21] Appl. No.: 654,894

[52] U.S. Cl. ..... 229/14 C; 206/320

[51] Int. Cl.[2] ..... B65D 5/58

[58] Field of Search ..... 229/14 C; 206/320, 326

[56] References Cited

UNITED STATES PATENTS

| | | | |
|---|---|---|---|
| 3,048,323 | 8/1962 | Stauffer | 229/14 C X |
| 3,107,780 | 10/1963 | Stuckert | 229/14 C X |
| 3,133,633 | 5/1964 | Redmond | 229/14 C X |
| 3,220,632 | 11/1965 | Persson | 229/14 C |
| 3,235,065 | 2/1966 | Deeren | 229/14 C X |
| 3,931,889 | 1/1976 | Roccaforte | 229/14 C X |

FOREIGN PATENTS OR APPLICATIONS

| | | | |
|---|---|---|---|
| 1,511,456 | 12/1967 | France | 229/14 C |

*Primary Examiner*—Davis T. Moorhead
*Attorney, Agent, or Firm*—Neuman, Williams, Anderson & Olson

[57] ABSTRACT

A packing insert is provided which is formed from a blank of foldable sheet material and is adapted to be disposed within a multi-sided container to position a product in a predetermined relation within the container interior. The insert includes a base panel having a peripheral configuration conforming substantially to the area defined by the side walls of the container. Foldably connected to the periphery of the base panel and disposed adjacent to predetermined corners thereof are a plurality of support units. Each unit has a first section thereof which overlies a surface of the base panel and a second section which projects therefrom. Each support unit is held in a set-up condition by an elongated retainer member which is struck out from the base panel.

11 Claims, 8 Drawing Figures

PACKING INSERT AND BLANK THEREFOR

BACKGROUND OF THE INVENTION

The packaging or crating of heavy, bulky items, such as water heaters, cylindrical tanks or the like, for shipment or storage has heretofore been a costly, ineffective and difficult operation. Normally such an operation required the talents of one or more skilled carpenters or persons possessed of a high degree of dexterity. Furthermore, the crating operation was awkward and time-consuming and necessitated maintaining a large inventory of lumber, fasteners such as nails and staples, and baling wire or steel strapping. Once the product was crated or packaged in accordance with prior practice, the exterior of the product was normally exposed to weather, dirt, dust or other foreign matter, and was susceptible to defacement or vandalism.

Because the top and bottom of the product, such as a water heater, normally embodied numerous exposed appurtenances, e.g. valves, gauges, pipe connectors, etc., it was difficult to properly encase and brace such appurtenances so as to prevent damage thereto during handling of the crated product.

SUMMARY OF THE INVENTION

Thus, it is an object of this invention to provide a packing insert which greatly facilitates the packaging of heavy, bulky products.

It is a further object of the invention to provide a packing insert which is formed from a single blank of inexpensive corrugated fiberboard which may be readily set up without requiring special tools, adhesive, staples and/or tape.

It is a further object of the invention to provide a packing insert which may be utilized in forming a package for a heavy, bulky product which requires a minimal number of components and wherein no portions of the accommodated product are exposed.

It is a still further object of the invention to provide components for packaging a heavy bulk product wherein the components may be stored in a collapsed or unfolded state, thereby avoiding inventory space problems.

It is a still further object of the invention to provide a packing insert which is capable of accommodating products which vary in size and shape over a wide range.

Further and additional objects will appear from the description, accompanying drawings, and appended claims.

In accordance with one embodiment of the invention, a packing insert is provided which is formed from a blank of foldable sheet material. The insert is adapted to be disposed within a multi-sided container and engage an end of the product so as to position the latter in a predetermined relation within the container interior. The insert includes a base panel having a peripheral configuration corresponding substantially to the area delimited by the side walls of the container. Foldably connected to peripheral segments of the base panel and adjacent the corners thereof are a plurality of support units. Each support unit includes a first section which is folded so as to overlie the surface of the base panel adjacent the accommodated product, and a second section foldably connected to the first section and projecting from the base panel surface. The base panel is provided with a plurality of struck-out elongated members which are adapted to interlock with portions of the second sections of the support units and retain the latter in folded set-up condition with respect to the base panel. The struck-out members cooperate with one another so as to delimit a centrally disposed pocket.

DESCRIPTION

For a more complete understanding of the invention, reference should be made to the drawings wherein.

Figure 7:
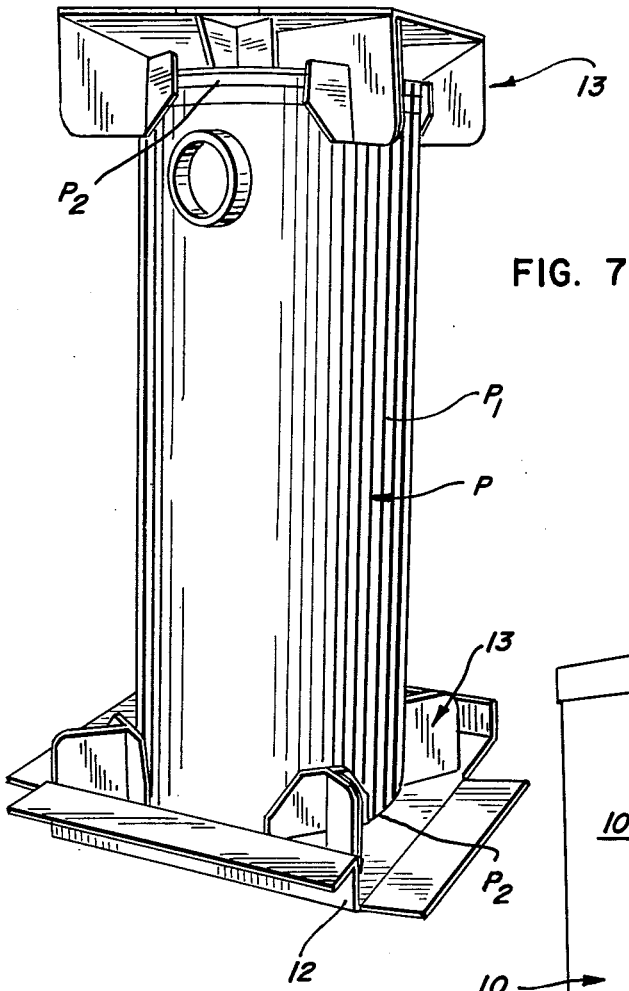
FIG. 7 is a perspective front view of a pair of packing inserts engaging opposite ends of an upright water heater prior to the latter being enclosed within a multisided container.
Figure 8:
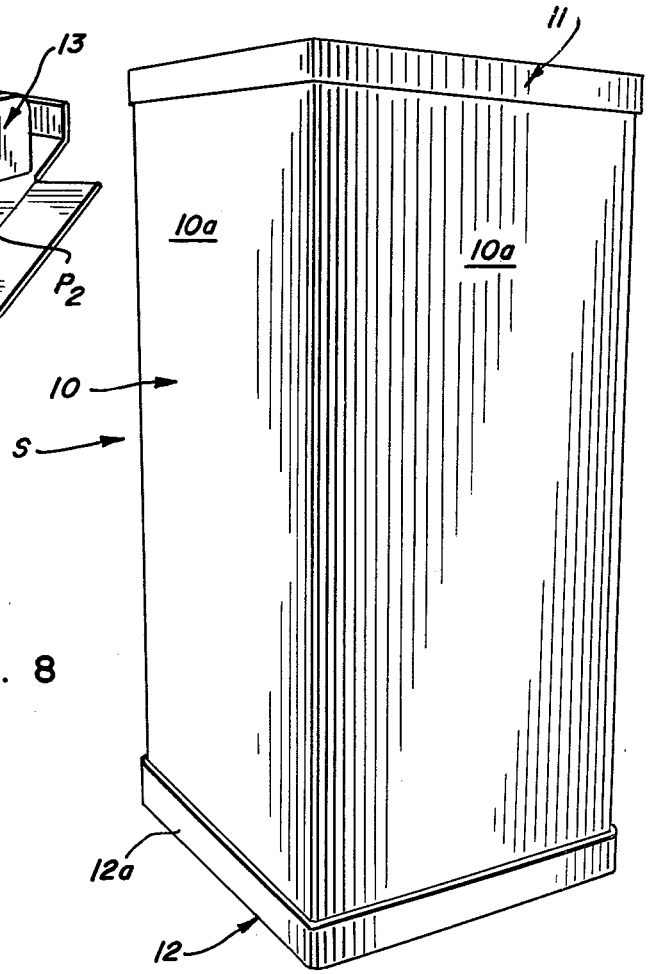
FIG. 8 is a perspective front view of a fully assembled shipping unit.

Referring now to the drawings and more particularly to FIG. 8, a shipping unit S is shown which is adapted to accommodate a bulky, heavy product P, such as a water heater, cylindrical tank or the like, see FIG. 7. The product P shown in FIG. 7 is a conventional water heater having a cylindrical center portion $P_1$ closed at the top and bottom by suitable end plates $P_2$. It is customary with water heaters for the end plates to include pipe connectors, valves and/or gauges and in the case of the bottom plate to include supporting legs, not shown. As aforementioned, in the past it has been difficult to properly package and brace these appurtenances when the water heater is being crated or packaged.

The unit S, as shown in FIG. 8, includes a multisided sleeve-like container 10 formed of suitable corrugated fiberboard material. The top and bottom of the container are preferably closed by conventional telescoping end closure pieces 11 and 12, respectively, which are formed of corrugated material and stapled or otherwise secured to the side walls 10*a* of the container. It will be noted in FIG. 8 that the product P is completely enclosed within the unit S and, thus, is effectively protected against dirt, dust or other foreign matter, and against defacement and possible vandalism.

As seen in FIG. 7, the product P is disposed in an upright position and the top and bottom thereof are engaged by the improved packing inserts 13 which are of like construction. Prior to the bottom of the product engaging the lower insert 13, the latter is first positioned on the blank from which the lower telescoping end closure piece 12 is formed. After the lower insert is in position on the end piece 12, the lower end of the product P is placed on the insert and then a second packing insert is placed over the upper end of the product, as seen in FIG. 7. Once the inserts 13 are in position relative to the ends of the product, the sleeve-like container 10 is slipped endwise over the top packing insert and down over the product until the bottom of the container 10 rests upon the blank of the end piece 12. As will be described hereinafter, the peripheral size and configuration of each packing insert closely approximates the area delimited by the side walls 10*a* of the container. Thus, once the container 10 is in place, lateral movement of the inserts is restrained by the container side walls. The blank of the bottom end piece 12 is then set up in a manner well known in the art so that the resulting upstanding flange 12*a* of the end piece 12 will embrace and be secured by staples or the like to the exterior of the lower portion of the container side walls. A similar end closure piece 11 is then placed over the top of the container and the upper packing insert and secured in a like manner to the container side walls.

In certain instances, in lieu of a separate upper end closure piece 11, the upper portions of the container side walls may be provided with closure flaps, not shown. Also, in certain instances, the blank of the lower end closure piece 12 may overlie and be secured to a pallet, not shown.

In place of slipping the container endwise over the packing inserts and product, the blank, not shown, from which the container is formed, may be wrapped around the product and inserts and a pair of side wall-forming panels of the container blank stapled, taped or otherwise secured together.

Figure 1:
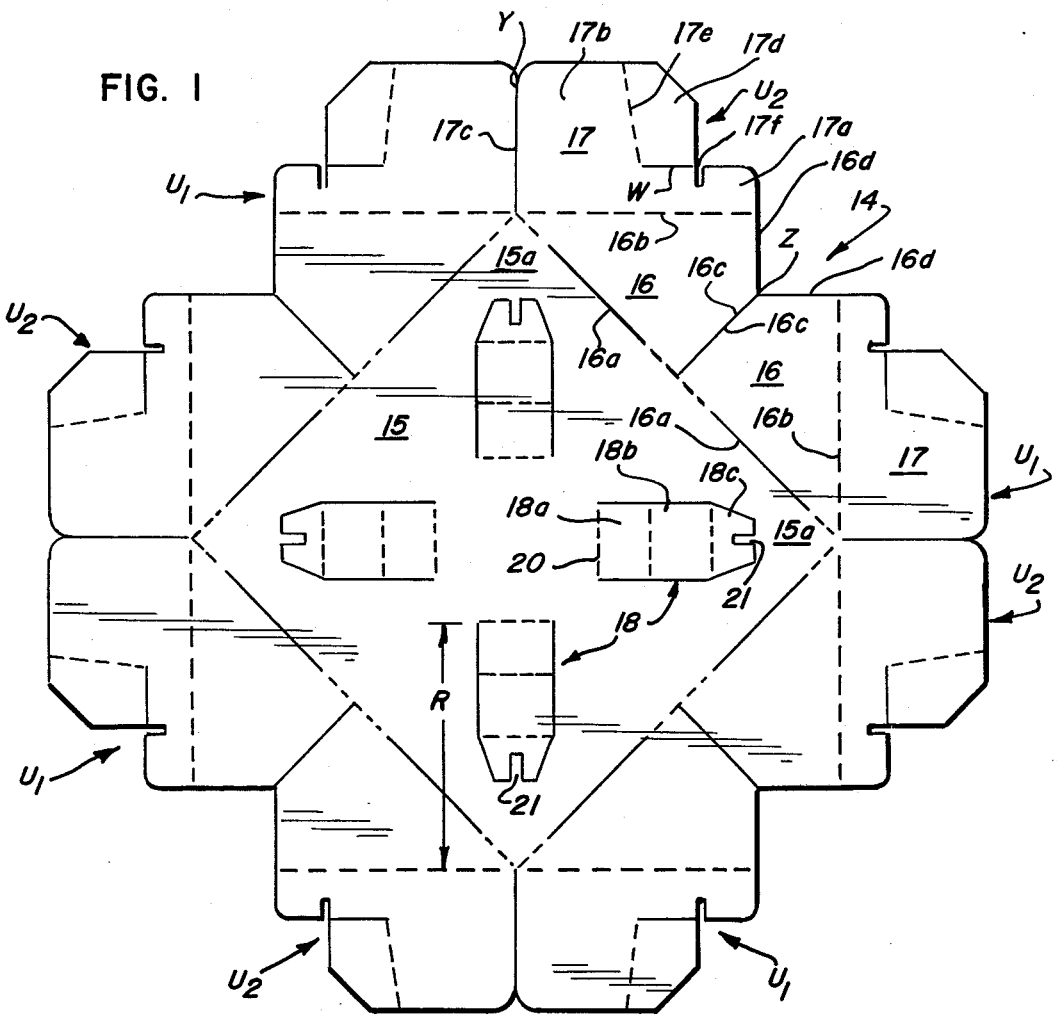
FIG. 1 is a top plan view of one form of a blank for the improved packing insert.
Figure 2:
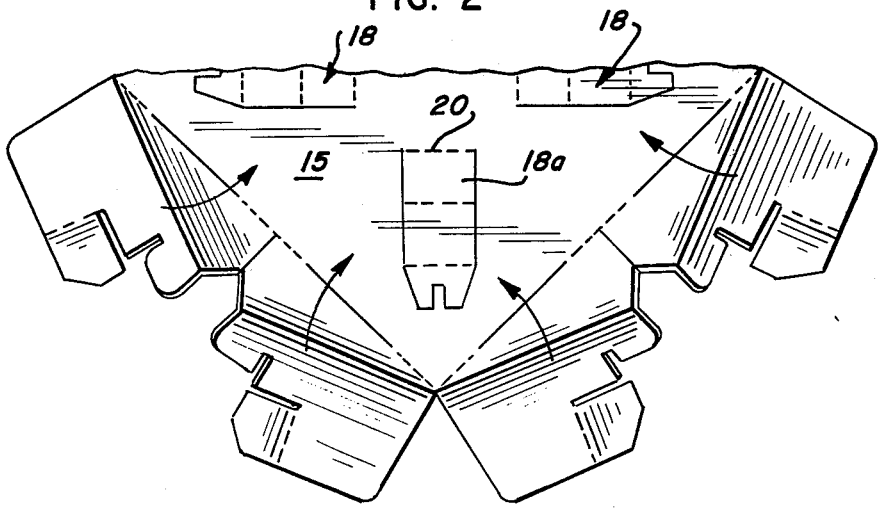
FIG. 2 is a fragmentary view similar to FIG. 1, but showing the support units in an initial stage of being folded into set-up condition.
Figure 3:
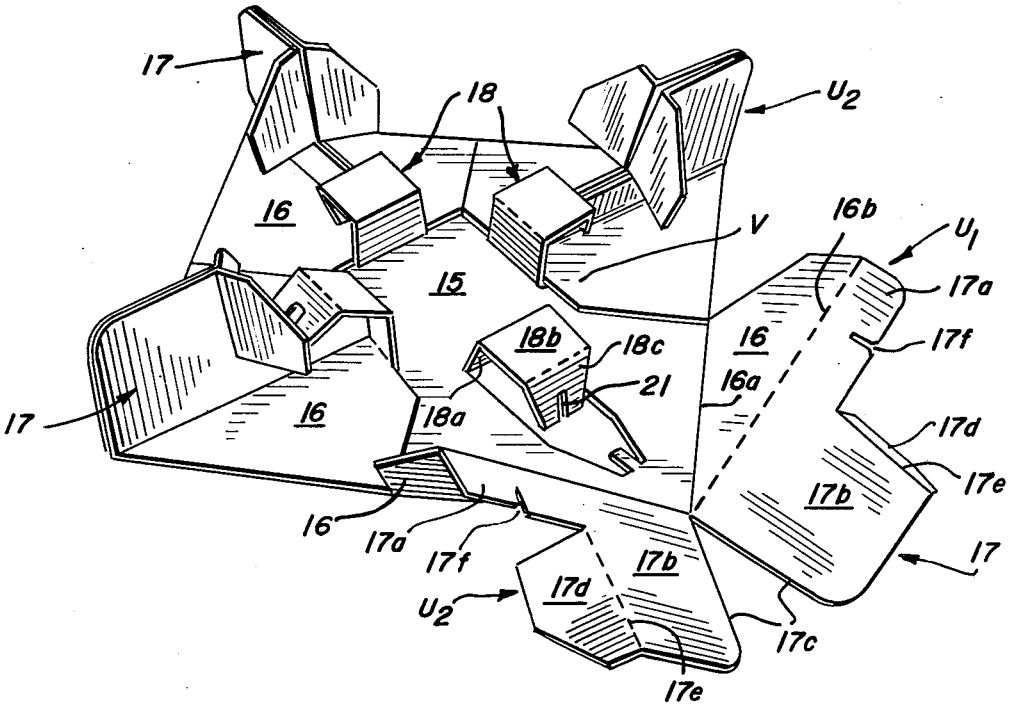
FIG. 3 is a perspective top view of the blank of FIG. 1 showing all but one pair of support units in fully set-up condition.

One form of blank 14 from which each packing insert 13 is formed is shown in FIG. 1. The blank is preferably of doubled-face corrugated fiberboard material and may be readily cut, scored and slotted by conventional high-speed equipment. The blank of FIG. 1 includes a base panel 15 which, in the illustrated embodiment, has a square peripheral configuration. The shape of the base panel may vary from that shown and will depend upon the shape of the container interior delimited by the side walls 10*a*. Disposed at each corner 15*a* of the base panel are a pair of support units $U_1$ and $U_2$. In the illustrated embodiment, all of the support units $U_1$ are of like configuration and similarly all of the support units $U_2$ are like configuration. The support units $U_1$ and $U_2$ disposed at each corner of the panel have mirror image configurations. To facilitate understanding of the packing insert construction, only one of the support units will be described in detail; however, corresponding parts of the remaining units will be identified with like numerals.

Support unit $U_1$ includes a first section 16 having an edge 16*a* thereof foldably connected to a peripheral segment of the base panel 15. Foldably connected to a second edge 16*b* of section 16 is a second section 17. A third edge 16*c* of section 16 is disposed adjacent to a corresponding edge of a unit $U_2$, the latter being foldably connected to the same peripheral edge of the base panel. The corresponding edges 16*c* of the units are separated from one another by an elongated slit Z. As seen in FIG. 1, the sum of the two section edges 16*a* of units $U_1$ and $U_2$ is equal to the distance between adjacent peripheral corners of the base panel 15. The slit Z is disposed transversely relative to the adjacent edge of the base panel 15, and the inner end of the slit terminates at the panel edge.

Unit section 16, in the illustrated embodiment, is provided with a fourth edge 16*d* which is disposed at a right angle to edge 16*b* and extends from edge 16*b* to edge 16*c*.

Unit section 17 embodies an inner portion 17*a* and an outer portion 17*b*. One edge 17*c* of outer portion 17*b* is formed by a slit Y, the inner end of which terminates at the adjacent base panel corner 15*a*. The edges 17*c* of the units $U_1$ and $U_2$, which are disposed adjacent a corner 15*a*, are coextensive with one another. A folding tab 17*d* is connected to a second edge 17*e* of the section 17 which is disposed opposite edge 17*c*, see FIG. 1. Tab 17*d* is separated from the inner portion 17*a* of section 17 by a slit W, the latter being in spaced substantially parallel relation with respect to edge 16*b* of the first section 16 of the support unit.

Inner portion 17*a* of section 17 has an open end slot 17*f* formed therein. The purpose of the slot will become apparent from the description hereinafter.

Base panel 15 is provided with a plurality of symmetrically arranged elongated members 18 which are struckout from said panel. In the illustrated embodiment, the number of members 15 corresponds to the number of corners 15*a* formed in the periphery of panel 15 and each member is of like configuration and includes an inner segment 18*a*, an intermediate segment 18*b* foldably connected thereto, and an outer segment 18*c* foldably connected to segment 18*b*. Inner segment 18*a* is connected by foldline 20 to panel 15. The distance R (see FIG. 1) that foldline 20 is disposed from the adjacent panel corner 15*a* is approximately equal to the length of edge 16*b* of the support unit section 16, so that when the blank is set up to form the packing insert 13, the inner edge of portion 17*a* of section 17 will abut the segment 18*a* of the adjacent member 18. The height of inner segment 18*a* is substantially equal to the distance between slit W and the foldline defining the edge 16*b* of section 16. Thus, when the elongated member 18 is in interlocking relation with a pair of folded support units $U_1$ and $U_2$, intermediate segment 18*b* will overlie the exposed edges of the portions 17*a* of the unit sections 17.

It will be noted in FIG. 1 that an edge of the outer segment 18*c* of each member 18 is provided with an open end slot 21 which is of sufficient size to straddle and retain in side-by-side relation the portions 17*a* of the pair of support units $U_1$ and $U_2$. Slot 21 interlocks with the slots 17*f* formed in the pair of units.

Figure 4:
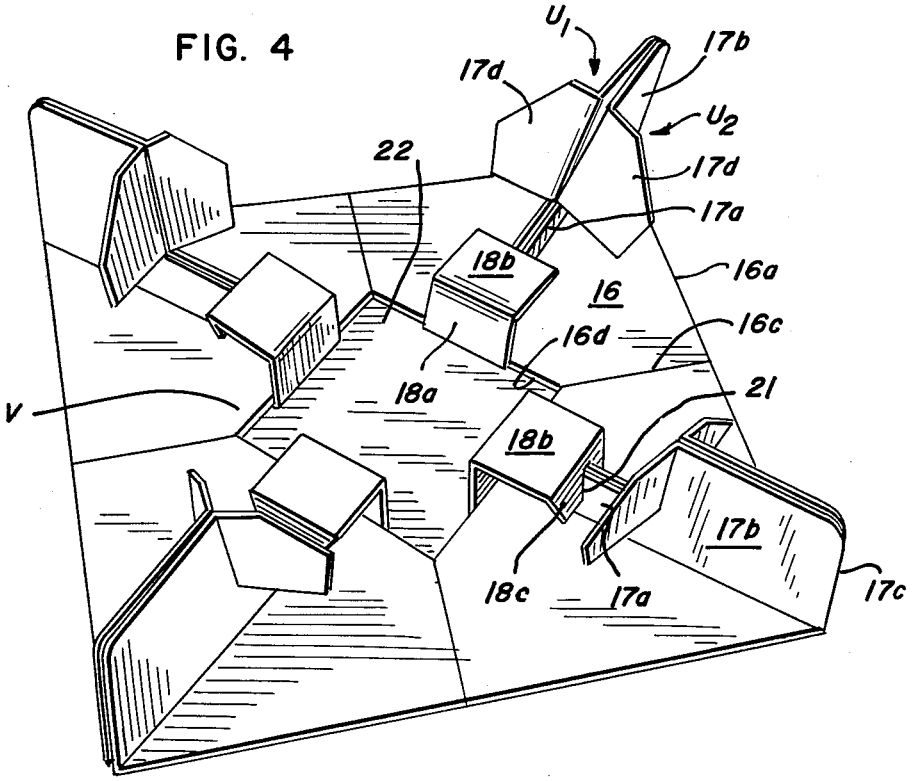
FIG. 4 is similar to FIG. 3 but showing all support units in fully set-up condition and the packing insert ready to engage an end of the product.
Figure 5:
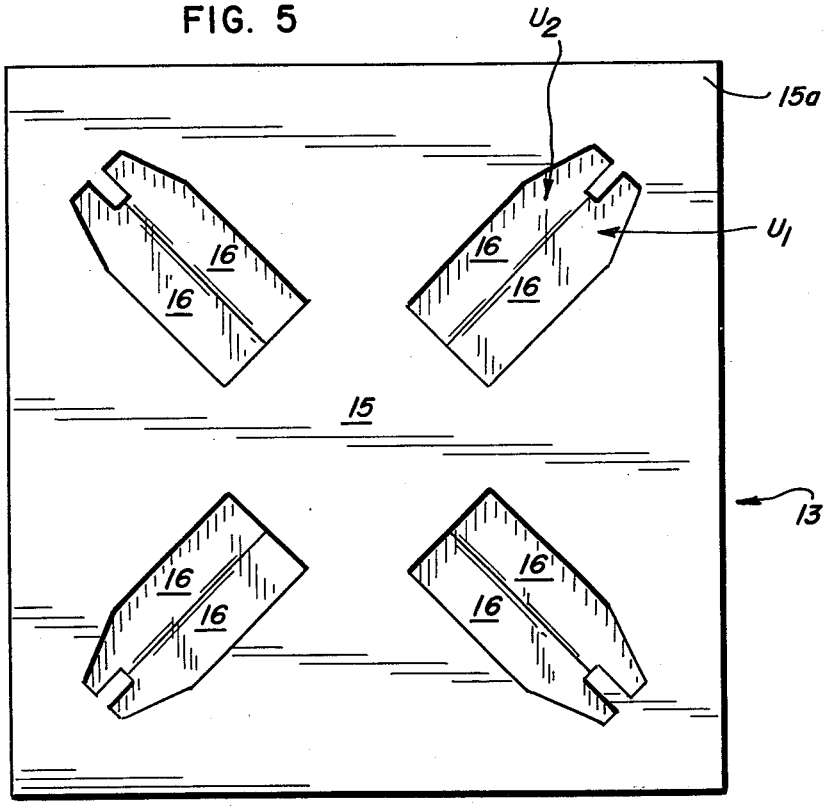
FIG. 5 is a bottom plan view of the blank of FIG. 1 in a fully set-up condition.
Figure 6:
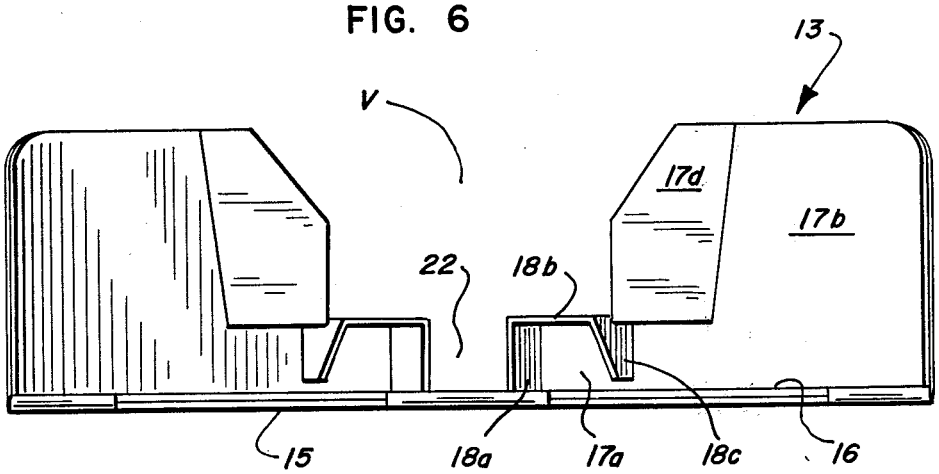
FIG. 6 is a side elevational view of the packing insert of FIG. 4.

It will be noted in FIG. 4 that inner segments 18*a* of members 18, when the latter are in set-up condition, coact with one another to form a centrally disposed pocket 22 which is adapted to accommodate any pipe connector or other appurtenances depending from the lower end plate $P_2$ of the product P. Furthermore, when the blank is set up, the voids V between adjacent members 18 prevent interference between the support units and any depending legs or feet formed on the accommodated product.

The intermediate segments 18*b* of the members 18 are adapted to supportingly engage the end plates $P_2$ of the product.

As seen in FIGS. 4 and 7, the tab 17*d*, which comprises a part of the second section of each support unit $U_1$ and $U_2$, is folded so as to assume a transverse position relative to the remainder 17*b* of the section when the blank is set up to form the packing insert 13. The tabs 17*d* for each pair of units disposed at a given corner, extend transversely in opposite directions and are adapted to resiliently engage exterior portions of the center portion $P_1$ of the product. The distance between the diametrically opposed pairs of tabs 17*d* in the packing insert 13 corresponds substantially to the outside diameter of the center portion $P_1$ of the product P and, thus, lateral shifting of the product relative to the insert when the product and inserts are disposed within the container 10 is avoided.

If there are no appurtenances formed on the end plate $P_2$ of the product P, then pocket 22 may be filled with a box-like element, not shown, formed of the same material as blank 14. The box-like element would have a height substantially the same as the height of inner segments 18*a* of the members 18 and a peripheral configuration similar to the area delimited by the inner segments 18*a*. When a box-like element is utilized, it coacts with the intermediate segments 18*b* of the members 18 to provide support for the end plate $P_2$ of the product P.

It will be understood, of course, that the configuration and size of the base panel 15, and the shape, size, number and relative location of the support units $U_1$ and $U_2$ may vary from that shown without departing from the scope of the invention.

Thus, it will be seen that an improved shipping unit, a packing insert for the unit, and a blank for the insert have been provided which are of simple and inexpensive construction and provide optimum protection for the accommodated product. The improved unit enables crating or packaging of a bulky, heavy product to be readily accomplished without requiring the talents of a carpenter or one possessed of a high degree of dexterity.

I claim:

1. A packing insert formed from a blank of foldable sheet material and adapted for disposition within a multi-sided container to position a product in a predetermined relation within the container interior, said insert comprising a base panel having a peripheral configuration corresponding substantially to the area delimited by the side walls of the container, a plurality of foldable support units adjacent predetermined corners of said base panel and protruding from a surface of said base panel and inwardly towards the center of said base panel, and a plurality of retainer means struck out from said base panel and interlocking with said support units and retaining same in predetermined folded relation with respect to said base panel, the number of said retainer means corresponding to the number of said predetermined corners; each support unit including a first section overlying in face-to-face relation a surface of said base panel, said first section being foldably connected to a peripheral segment of said base panel adjacent a predetermined corner of said base panel, and a second section disposed inwardly of the periphery of said base panel and being foldably connected to said first section and protruding transversely from said base panel surface, said second section having an inner portion thereof engaged and retained by a retainer means in said transversely protruding relation with respect to said base panel surface.

2. The packing insert of claim 1 wherein a pair of complemental support units are disposed adjacent each predetermined corner, and each pair of support units is interlocked by a retainer means whereby the second sections of said pair of support units are retained in transversely protruding relation with respect to said base panel surface.

3. The packing insert of claim 1 wherein a pair of complemental support units is disposed adjacent each corner of the base panel and the distance between adjacent corners of the base panel being spanned by the first sections of adjacent support units foldably connected to the peripheral segments of the base panel disposed intermediate said adjacent corners.

4. The packing insert of claim 1 wherein each struck-out retainer means includes an elongated member having an inner segment foldably connected to said base panel and projecting angularly therefrom, an intermediate segment extending angularly from said inner segment towards the periphery of said base panel and overlying the inner portion of the second section of a support unit, and an outer segment extending angularly from said intermediate segment towards said base panel surface and interlocking with the support unit inner portion.

5. The packing insert of claim 4 wherein the intermediate segment of each struck-out elongated member is adapted to supportingly engage a product disposed within the container.

6. The packing insert of claim 5 wherein each support unit has the second section thereof provided with an outer portion which includes a tab folded relative to the remainder of the outer portion for engaging the exterior of a product disposed within the container.

7. The packing insert of claim 4 wherein the inner segments of said elongated members cooperate with one another to form a central pocket for accommodating appurtenances formed on the product disposed within the container.

8. A blank of foldable sheet material for use in forming a packing insert adapted to be disposed within a multi-sided container to position a product in a predetermined relation within the container interior, said blank comprising a base panel having a multi-sided periphery with adjacent sides thereof defining corners, the configuration of said base panel corresponding substantially to the area delimited by side walls of the container; a plurality of support units foldably connected to the base panel periphery and disposed adjacent to and on opposite sides of predetermined corners of said base panel, each support unit including a first section foldably connected to a peripheral side of said base panel and being adapted to overlie a surface of said base panel when said blank is set up to form the packing insert, and a second section foldably connected to said first section, the foldline connections between a first section and said base panel and between the first section and a second section defining an acute included angle, said second section being adapted to protrude from the base panel surface when said blank is set up; and a plurality of elongated members struck out from said base panel, said elongated members being in substantial radial alignment with said predetermined corners and being adapted to interlockingly engage the second sections of the support units when the blank is set up.

9. The blank of claim 8 wherein a pair of support units of like configuration is disposed adjacent each corner of said base panel, the second sections of said pair of support units being separated from one another by an elongated slit having one end thereof terminating at the corner.

10. The blank of claim 9 wherein the number of elongated members struck out from said base panel corresponds to the number of corners formed in the periphery of said base panel, the longitudinal axis of each elongated member being aligned with the slit separating the second sections of a pair of support units.

11. The blank of claim 9 wherein the second section of each support unit includes a tab foldable about a foldline spaced from the slit and angularly disposed relative to a foldline connecting said second section to said first section.

* * * * *